United States Patent [19]

Poehlman

[11] Patent Number: 4,489,699

[45] **Date of Patent: * Dec. 25, 1984**

[54] CONTROL MECHANISM FOR SELECTIVELY OPERATING AN INTERNAL COMBUSTION ENGINE ON TWO FUELS

[75] Inventor: Arthur G. Poehlman, West Bend, Wis.

[73] Assignee: Outboard Marine Corporation, Waukegan, Ill.

[ * ] Notice: The portion of the term of this patent subsequent to Jul. 19, 2000 has been disclaimed.

[21] Appl. No.: 376,399

[22] Filed: May 10, 1982

Related U.S. Application Data

[63] Continuation-in-part of Ser. No. 314,225, Oct. 23, 1981, Pat. No. 4,393,848.

[51] Int. Cl.[3] ..... F02M 21/02

[52] U.S. Cl. ..... 123/525; 123/575; 48/180 R

[58] Field of Search ..... 123/525, 527, 526, 575; 48/180 R, 180 C; 261/16

[56] References Cited

U.S. PATENT DOCUMENTS

| | | | |
|---|---|---|---|
| 1,973,142 | 9/1934 | Day et al. | 123/527 |
| 2,315,882 | 4/1943 | Trimble et al. | 123/527 |
| 2,381,304 | 8/1945 | Merrill | 123/527 |
| 4,068,639 | 1/1978 | Cook | 123/525 |
| 4,227,497 | 10/1980 | Mathieson | 123/525 |
| 4,335,697 | 6/1982 | McLean | 123/525 |

*Primary Examiner*—Ethel R. Cross

*Attorney, Agent, or Firm*—Michael, Best & Friedrich

[57] ABSTRACT

Disclosed herein is an apparatus which is adapted for controlling operation of an internal combustion engine operable selectively which is on gaseous fuel or liquid fuel, and which comprises a gaseous fuel supply line extending between the engine and a source of gaseous fuel, a liquid fuel supply line extending between the engine and a source of liquid fuel, and a control for controlling supply to the engine of the gaseous fuel and the liquid fuel, which control includes an operator controlled fuel selector switch movable between a gaseous fuel position and a liquid fuel position, which control is operable following prior engine operation with gaseous fuel and in response to movement of the fuel selector switch from the gaseous fuel position to the liquid fuel position for permitting liquid fuel flow through the liquid fuel supply line, for permitting continued gaseous fuel flow through the gaseous fuel supply line until initiation of liquid fuel combustion, and thereafter preventing further gaseous fuel flow through the gaseous fuel supply until repositioning of the fuel selector switch to the gaseous fuel position, and which control is also operable following prior engine operation with liquid fuel and in response to movement of the fuel selector switch from the liquid fuel position to the gaseous fuel position for preventing further liquid fuel flow through the liquid fuel supply line, for preventing gaseous fuel flow through the gaseous fuel supply line until termination of liquid fuel combustion, and for thereafter permitting gaseous fuel flow through the gaseous fuel supply line until repositioning of the fuel selector switch to the liquid fuel position.

37 Claims, 5 Drawing Figures

SOURCE OF D.C. CURRENT
59
51
57
53
55
81
61
65
63
113
83
71
79
73
77
101
47
93
41
95
97
99
115
111
11
33
31
25
45
43
19
21
GASEOUS FUEL SOURCE
27
LIQUID FUEL SOURCE
28
25
19
15
17
107
103
105
13
INTERNAL COMBUSTION ENGINE

CONTROL MECHANISM FOR SELECTIVELY OPERATING AN INTERNAL COMBUSTION ENGINE ON TWO FUELS

RELATED INVENTION

This application is a continuation-in-part of my earlier application Ser. No. 314,225 filed Oct. 23, 1981, now U.S. Pat. No. 4,393,848.

BACKGROUND OF THE INVENTION

The invention relates generally to operation of an internal combustion engine on two fuels. More particularly, the invention relates to selective operation of an internal combustion engine on a liquid fuel and on a gaseous fuel.

Still more particularly, the invention relates to means for controlling selective operation of an internal combustion engine on natural gas and on gasoline.

SUMMARY OF THE INVENTION

The invention provides an apparatus for controlling operation of an internal combustion engine which is selectively operable using gaseous fuel or liquid fuel, which apparatus comprises a gaseous fuel supply line extending between the engine and a source of gaseous fuel, a liquid fuel supply line extending between the engine and a source of liquid fuel, and means for controlling supply to the engine of the gaseous fuel and the liquid fuel, which control means includes an operator controlled fuel selector switch movable between a gaseous fuel position and a liquid fuel position, which control means is operable following prior engine operation with gaseous fuel and in response to movement of the fuel selector switch from the gaseous fuel position to the liquid fuel position for permitting liquid fuel flow through the liquid fuel supply line, for permitting continued gaseous fuel flow through the gaseous fuel supply line until initiation of liquid fuel combustion, and thereafter preventing further gaseous fuel flow through the gaseous fuel supply line until repositioning of the fuel selector switch to the gaseous fuel position, and which control means is also operable following prior engine operation with liquid fuel and in response to movement of the fuel selector switch from the liquid fuel position to the gaseous fuel position for preventing further liquid fuel flow through the liquid fuel supply line, for preventing gaseous fuel flow through the gaseous fuel supply line until termination of liquid fuel combustion, and for thereafter permitting gaseous fuel flow through the gaseous fuel supply line until repositioning of the fuel selector switch to the liquid fuel position.

In one embodiment of the invention, the control means also includes vacuum operated means responsive to engine vacuum condition for controlling gaseous fuel flow through the gaseous fuel supply line.

In one embodiment of the invention, the apparatus comprises means for supplying a gaseous fuel to the engine, means for supplying liquid fuel to the engine, and control means connected to a source of vacuum which is responsive to engine operation and which varies relative to a predetermined level, which control mean includes a fuel selector switch movable between a gaseous fuel position and a liquid fuel position, an electrically operated, normally closed gaseous fuel control valve which is located in the gaseous fuel supply means, which is operable between open and closed positions, and which is opened in response to electrical energization thereof, and an electrically operated, normally closed liquid fuel control valve which is located in the liquid fuel supply means, which is operable between open and closed positions, and which is opened in response to electrical energization thereof. The control means is operable, when the selector switch is in the liquid fuel position, to energize the liquid fuel control valve, thereby opening the liquid fuel control valve; is also operable, when the selector switch is in the liquid fuel position and in response to the presence of an amount of vacuum above the predetermined level to energize the gaseous fuel control valve; is also operable, when the selector switch is in the liquid fuel position and in response to the presence of an amount of vacuum below the predetermined level, to deenergize the gaseous fuel control valve, and thereby close the gaseous fuel control valve, and thereafter to retain the gaseous fuel control valve deenergized regardless of vacuum variation; is also operable, when the selector switch is in the gaseous fuel position, to deenergize the liquid fuel control valve, thereby closing the liquid fuel control valve; is also operable, when the selector switch is in the gaseous fuel position and in response to an amount of vacuum above the predetermined level, to deenergize the gaseous fuel control valve, thereby closing the gaseous fuel control valve; and is also operable, when the selector switch is in the gaseous fuel position and in response to an amount of vacuum below the predetermined level, to energize the gaseous fuel control valve and thereby open the gaseous fuel control valve, and thereafter to retain energization of the gaseous fuel control valve regardless of vacuum variation.

In one embodiment of the invention, the apparatus further includes electrically operated spark advance means electrically connected to the control means and operable in response to energization thereof to advance the sparking time, and electrically operated intake air heating means electrically connected to the control means, and operable in response to energization thereof to discontinue heating the incoming air, and the control means is inoperable, when the selector switch is in the liquid fuel position, to energize the spark advance means and the air intake means; and is operable, when the selector switch is in the gaseous fuel position and in response to an amount of vacuum above the predetermined level, to deenergize the spark advance means and the inlet air heating means, and is also operable, when the selector switch is in the gaseous fuel position and in response to an amount of vacuum below the predetermined level, to energize the spark advance means and the inlet air heating means, and thereafter to retain energization of the spark advance means and the intake air heating means regardless of vacuum variation.

In one embodiment of the invention, the engine includes a fuel inlet manifold and the vacuum switch communicates with the fuel inlet manifold and is subject to the pressure variation in the fuel inlet manifold.

Other features and advantages of the embodiments of the invention will become known by reference to the following general description, claims and appended drawings.

IN THE DRAWINGS

Figure 1:
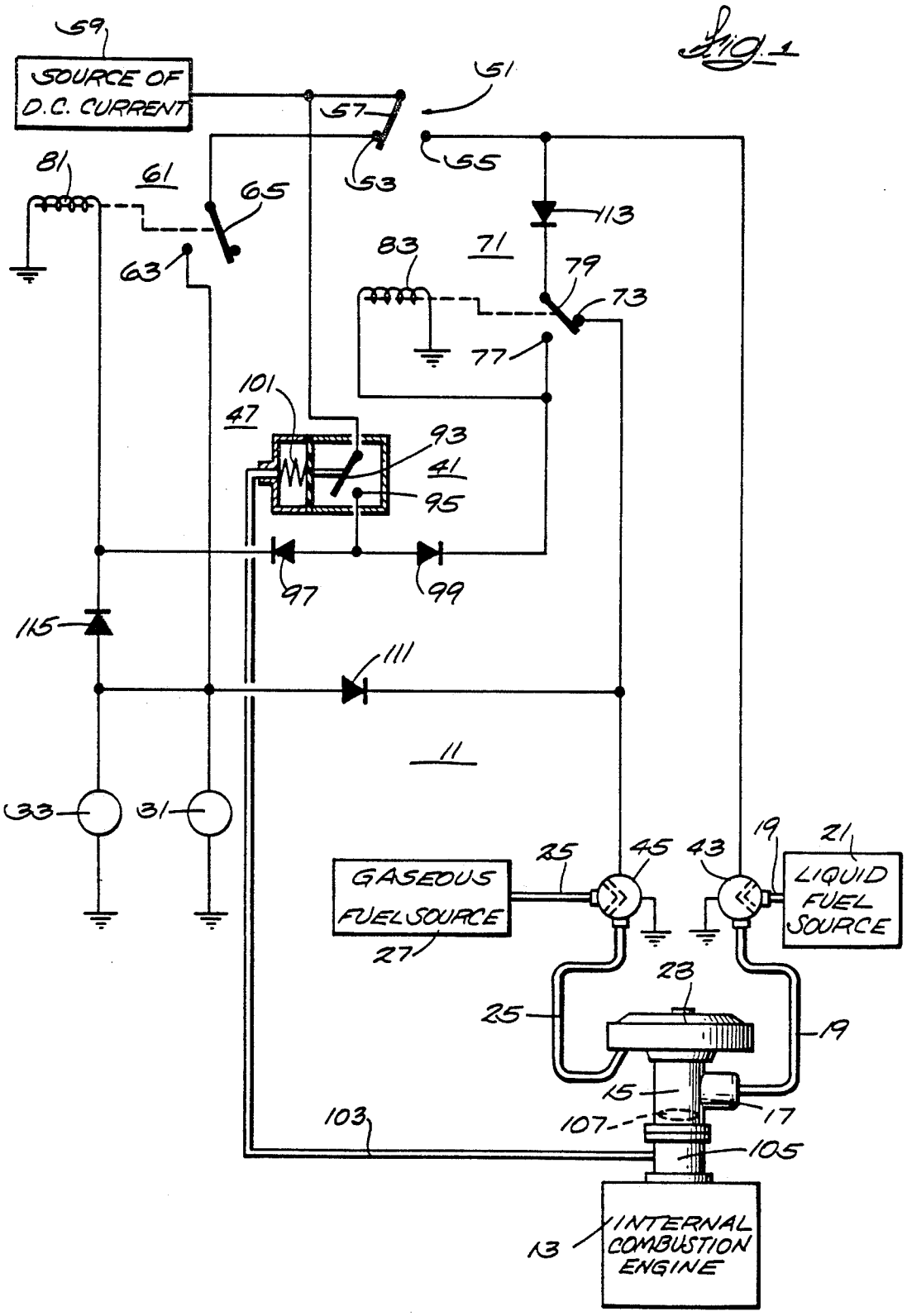
FIG. 1 is a schematic view of one embodiment of a control apparatus for selectively operating an internal combustion engine on differing fuels.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is control apparatus 11 for selectively operating an internal combustion engine 13 on a first or gaseous fuel and on a second or liquid fuel. The engine includes a carburetor 15 incorporating a float bowl 17 which is connected through a supply line 19 with a source 21 of liquid fuel, such as, for instance, gasoline. Other liquid fuels could be used. The engine 13 also includes a gaseous fuel air mixer 23 which communicates with the carburetor 15, and which is connected through a supply line 25 with a source 27 of gaseous fuel, such as, for instance, natural gas. Other gaseous fuels could be used.

The engine 13 also includes an ignition system (not shown) which incorporates spark advancing means 31 (schematically illustrated) for varying the time of sparking between retarded sparking and advanced sparking. Such spark advancing means 31 is biased toward retarded sparking, permits variation in the time of sparking operating when the engine 13 is operating on liquid fuel, and maintaining advanced sparking when the engine 13 is operating on gaseous fuel. The spark advance means 31 is operative in response to electrical energization to maintain the spark advanced when operating on gaseous fuel. Other than as explained above, the details of the spark advancing means 31 do not form a part of this invention. One suitable spark advancing means is disclosed in application Ser. No. 314,227, filed Oct. 23, 1981 and entitled "Spark Advance Mechanism for Dual Fuel Engine" which is incorporated herein by reference.

The engine 13 also includes means 33 for heating the intake air when the engine 13 is operating on liquid fuel. The intake air heating means 33 is operative to prevent heating of the incoming air in response to electrical energization and, in the absence of electrical energization, serves to heat the incoming air. Any suitable intake air heating means can be employed.

The engine 13 also includes control means 41 for selective change-over between use of liquid fuel and gaseous fuel. In this regard, the control means 41 includes a liquid fuel control valve 43 which is incorporated in the liquid fuel supply line 19, which is movable between open and closed positions, which is biased to the closed position, and which, in response to electrical energization, moves to the open position to afford liquid fuel flow to the engine 13.

The control means 41 also includes a gaseous fuel control valve 45 which is incorporated in the gaseous fuel supply line 25, which is movable between open and closed positions, which is biased to the closed position, and which, in response to electrical energization, moves to the open position to afford gaseous fuel flow to the engine.

Still further in addition, the control means 41 includes a vacuum control switch 47 which is subject to variation in the amount of vacuum, which is normally closed, and which opens in response to the presence at the vacuum switch 47 of an amount of vacuum above a predetermined amount.

Still further in addition, the control means 41 includes a primary or fuel selector switch 51 which is operator-controlled and which is movable between a first or gaseous fuel position, and a second or liquid fuel position.

The control means 41 is operable, when the selector switch 51 is in the liquid fuel position, to energize the liquid fuel control valve 43, thereby opening the liquid fuel control valve 43. In addition, the control means 41 is operable, when the selector switch 51 is in the liquid fuel position and in response to the presence at the vacuum switch 47 of an amount of vacuum above the predetermined level, to energize the gaseous fuel control valve 45, and thereby open the gaseous fuel control valve 45.

Still further in addition the control means 41 is operable, when the selector switch 51 is in the liquid fuel position and in response to the presence at the vacuum switch 47 of an amount of vacuum below the predetermined level, to deenergize the gaseous fuel control valve 45, and therefore close the gaseous fuel control valve, and thereafter to retain the gaseous fuel control valve 45 deenergized regardless of variation of vacuum until the fuel selector switch 51 is moved to the gaseous fuel position.

The control means 41 is also inoperative, when the selector switch 51 is in the gasoline position, to energize the spark advance means 31 and the intake air heating means 33.

The control means 41 is also operable, when the selector switch 51 is in the gaseous fuel position, to deenergize the liquid fuel control means 43, thereby closing the liquid fuel control valve 43. In addition, the control means 41 is also operable when the selector switch 51 is in the gaseous fuel position and in response to the presence at the vacuum switch 47 of an amount of vacuum above the predetermined level, to deenergize the gaseous fuel control valve 45, thereby closing the gaseous fuel control valve 45, to deenergize the spark advance means 31, and to deenergize the intake air heating means 33. Still further in addition, the control means 41 is also operable, when the selector switch 51 is in the gaseous fuel position and in response to the presence at the vacuum switch 47 of an amount of vacuum below the predetermined level, to energize the gaseous fuel control valve 45, and thereby open the gaseous fuel control valve 45, to energize the spark advance means 31, and the intake air heating means 33, and to thereafter retain energization of the gaseous fuel control valve 45, the spark advance means 31 and the intake air heating means 33, regardless of variation in vacuum until movement of the fuel selector switch 51 to the liquid fuel position by an operator.

More particularly, the selector switch 51 comprises a gaseous fuel terminal 53, a liquid fuel terminal 55, and a primary switch member 57 connected to a source 59 of direct current and movable between a first position energizing the liquid fuel terminal 55 and a second position energizing the gaseous fuel terminal 53.

The control means 41 further includes a first switch means 61 including an energizing and holding terminal 63 connected to the gaseous fuel control valve 45, to the spark advance means 31, and to the intake air heating means 33. In addition, the first switch means 61 includes a first switch member 65 connected to the gaseous fuel terminal 53 of the selector switch 51 and movable to and from a position energizing the energizing and holding terminal 63, means (not shown) biasing the first switch member 65 away from the energizing and holding terminal 63, and means connected to the energizing and holding terminal 63 for holding the first switch member 65 in the position energizing the energizing and holding terminal 63 when the energizing and holding terminal is energized.

The control means 41 also includes a second switch means 71 including a terminal 73 connected to the gaseous fuel control valve 45, a holding terminal 77, and a second switch member 79 electrically connected to the liquid fuel terminal 55 of the selector switch 51 and movable between a first position energizing the terminal 73 connected to the gaseous fuel control valve 45 for energization thereof, and a second position energizing the holding terminal 77, means (not shown) biasing the second switch member 79 to the first position, and means connected to the holding terminal 77 for holding the second switch member 79 in the second position against the action of the biasing means when the holding terminal 77 is energized.

Still more specifically, the first and second switches 61 and 71 respectively include solenoid coils 81 and 83 which, when energized, cause movement of the respective first and second switch members 65 and 79 from their biased positions to their respective positions in engagement with the energizing and holding terminal 63 and the holding terminal 77.

The vacuum switch 47 includes a switch member 93 which is connected to the source 59 of direct current and which is movable between open and closed positions relative to a second terminal 95 which, in turn, is connected through diodes 97 and 99 to the respective solenoid coils 81 and 83.

The switch member 93 is biased by a spring 101 to the closed position, and opens in response to the presence at the vacuum switch 47 of an amount of vacuum above a predetermined level. In this last regard, the vacuum switch is connected by a suitable conduit 103 to the engine intake manifold 105 and therefore senses the vacuum condition at the intake manifold 105. In this regard, as already indicated, a small amount of vacuum below the predetermined level is ineffective to open the vacuum switch 47. Such small amounts of vacuum occur during high speed and acceleration conditions in which the engine throttle 107 is opened and, thus, there is no impediment to fuel mixture flowing to the engine cylinders (not shown). However, during idling and lesser speed operations, the engine throttle 107 is either closed or partially opened, causing a greater amount of vacuum to be present in the engine intake manifold 105. When such a greater amount of vacuum above the predetermined level is present, the vacuum switch 47 opens against the bais of the spring 101.

The control means 41 also includes a diode 111 which prevents energization of the intake air heating means 33 and the spark advance means 31 when the fuel selector switch 51 is in the liquid fuel position and the second switch member 79 is in the first position energizing the terminal 73 and hence the gaseous fuel control valve 45.

Still further, a diode 113 is interposed in the electrical connection between the second switch member 79 and the liquid fuel terminal 55 of the primary switch 51 to prevent current flow from the second switch member 79 to the liquid fuel terminal 55 of the primary switch 51. Still further in addition, a diode 115 is provided between the energizing terminal 63 of the first switch and the solenoid coil 81 so as to prevent flow from the solenoid coil 81 to the gaseous fuel control valve 45 and/or the spark advance means 31 and/or the intake heating means 31, while at the same time, affording current flow to the solenoid coil 81 for holding action of the first switch member 65 in engagement with the energizing terminal 63.

In operation, when switching from liquid fuel to gaseous fuel, the operator moves the fuel selector switch 51 to the gaseous fuel position. As a result, the liquid fuel control valve 43 is consequently deenergized and turns off the liquid fuel supply to the carburetor 15. However, the engine continues to run on the liquid fuel in the carburetor bowl 17. The inlet manifold vacuum remains above the predetermined level of the vacuum switch 47 at idle or normal road speeds until the engine begins to run out of the liquid fuel in the fuel bowl 17. The vacuum then drops to an amount less than or below the predetermined level thereby closing the vacuum switch 47 which energizes the solenoid coils 81 and 83. The first solenoid coil 81 acts to displace the first switch member 65 to the terminal 63, thereby energizing the gaseous fuel control valve 45 to the open position, and thereby also energizing the spark advance means 31 and the inlet air heating means 33. Energization of the terminal 63 also serves to hold the solenoid coil 81 in the energized state, thereby retaining the gaseous fuel control valve 45 in opened condition, regardless of variation of the vacuum condition at the vacuum switch 47.

To change to liquid fuel from gaseous fuel, the operator moves the fuel selector switch 51 to the liquid fuel position. Such movement energizes the liquid fuel control valve 53 to the open position and the carburetor bowl 17 begins to fill. However, the engine 13 will not run on liquid fuel until the carburetor bowl 17 is nearly full. During the time interval when the carburetor bowl is filling, the gaseous fuel control valve 45 is retained open by engagement of the second switch member 79 with the terminal 73. Thus, the engine 13 continues to run on gaseous fuel with the vacuum condition at the vacuum switch above the predetermined level until the engine 13 begins to run on both fuels. The vacuum condition at the vacuum switch 47 then drops below the predetermined level, thereby closing the vacuum switch 47, which closure energizes the second solenoid coil 83. Energizing of the second solenoid coil 83 shifts the second switch member 79 to the holding terminal 77, thereby deenergizing the gaseous fuel control valve 45 so as to effect closure thereof. At the same time, energization of the holding terminal 77 serves to latch the second solenoid coil 83 in an energized state so that the gaseous fuel control valve 45 remains in the off position, notwithstanding variation in vacuum condition at the vacuum switch 47. In addition, the spark advance means 31 and the inlet air heating means 33 are opened immediately upon the shifting of the fuel selector switch 51 to the liquid fuel position. If such deenergization of the spark advance means 31 and the inlet air heating means 33 is not accomplished, the vacuum condition at the vacuum switch 47 may remain greater than the predetermined level when idling on both fuels, thereby preventing closure of the vacuum switch 47 and completion of the change-over to liquid fuel.

The diode 111 prevents the inlet air heating means and the spark advance means from being energized during the switch-over to liquid fuel. The diode 113 prevents the fuel control valve 43 from being energized during normal gaseous fuel operation. The disclosed automatic change-over system will work as described at idle and steady speeds below about 50 mph. If the change-over is attempted at a heavy load, low-vacuum condition, the engine will lose power for a few seconds. However, inertia of the vehicle powered by the engine 13 will drive the engine 13 until the correct fuel mixture is supplied.

Figure 2:
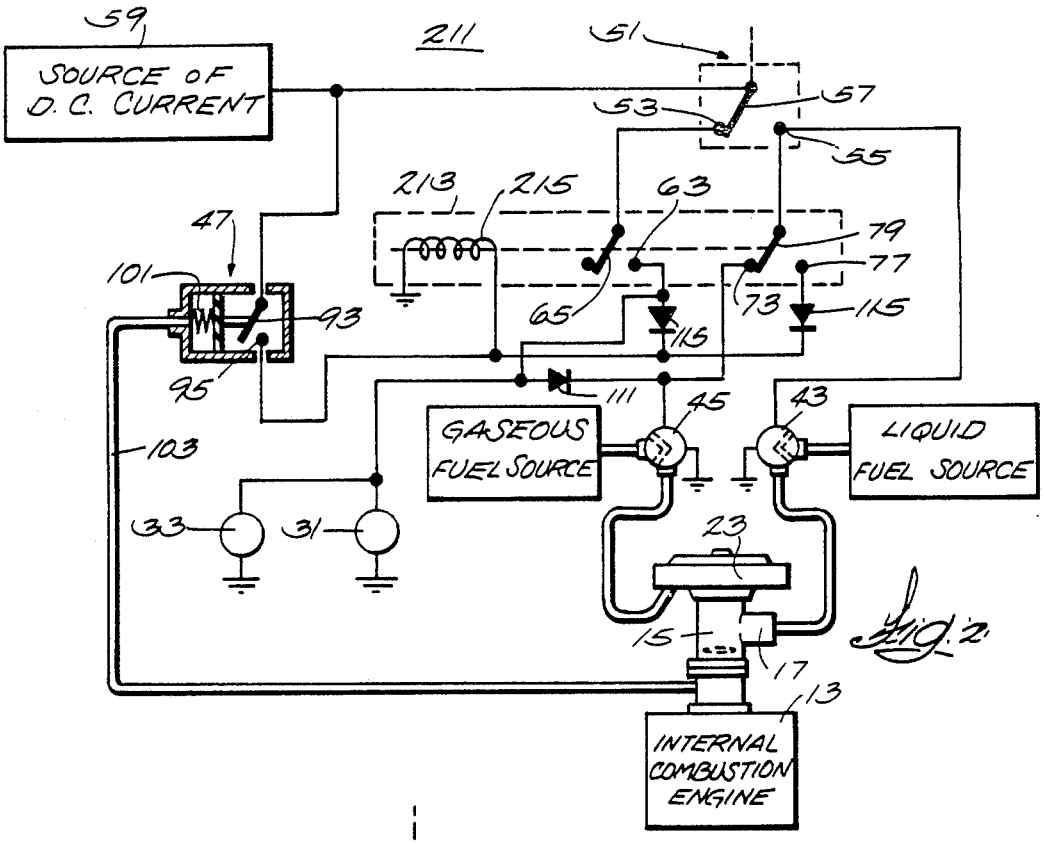
FIG. 2 is a schematic view of a second embodiment of a control apparatus for selectively operating an internal combustion engine on differing fuels.

Shown in FIG. 2 is another embodiment of a control apparatus 211 for selectively operating an internal combustion engine 13 on a first or gaseous fuel and on a second or liquid fuel. As various of the components of the control apparatus 211 are identical to like components of the control apparatus 11 shown in FIG. 1, the same reference numerals as applied in FIG. 1 are also applied to like components of the control apparatus 211, and no further description will be provided except as follows.

The control apparatus 211 shown in FIG. 2 differs primarily from the control apparatus 211 shown in FIG. 1 by reason of the employment of a single double pole solenoid switch 213 in lieu of the solenoid switches 61 and 71 shown in FIG. 1. The switch 213 includes a single solenoid coil 215 which is electrically connected to the terminal 95 of the vacuum switch 47.

The solenoid switch 213 controls a first switch member 65 which is movable relative to an engergizing terminal 63 and a second switch member 79 which is movable between a terminal 73 connected to the gaseous fuel control valve 45 and a holding terminal 77. The switch members 65 and 79 have common movement and are suitably biased by means (not shown) for movement of the switch member 65 away from the terminal 63 and for movement of the switch member 79 away from the terminal 77.

Unlike the arrangement shown in FIG. 1, both the terminals 63 and 77 are connected to the solenoid coil so as to hold the solenoid coil 215 in energized condition in response to energization of the terminals 63 and 77 consequent to movement of the switch members 65 and 79 thereto by action of the vacuum switch 47. In addition, the control apparatus 211 shown in FIG. 2 includes two diodes 115 in the respective leads extending from the terminals 63 and 77 and connected to the solenoid coil 215. In general, the operation of the control apparatus 211 shown in FIG. 2 is identical to that of the control apparatus 11 shown in FIG. 1 except as immediately noted above.

Figure 3:
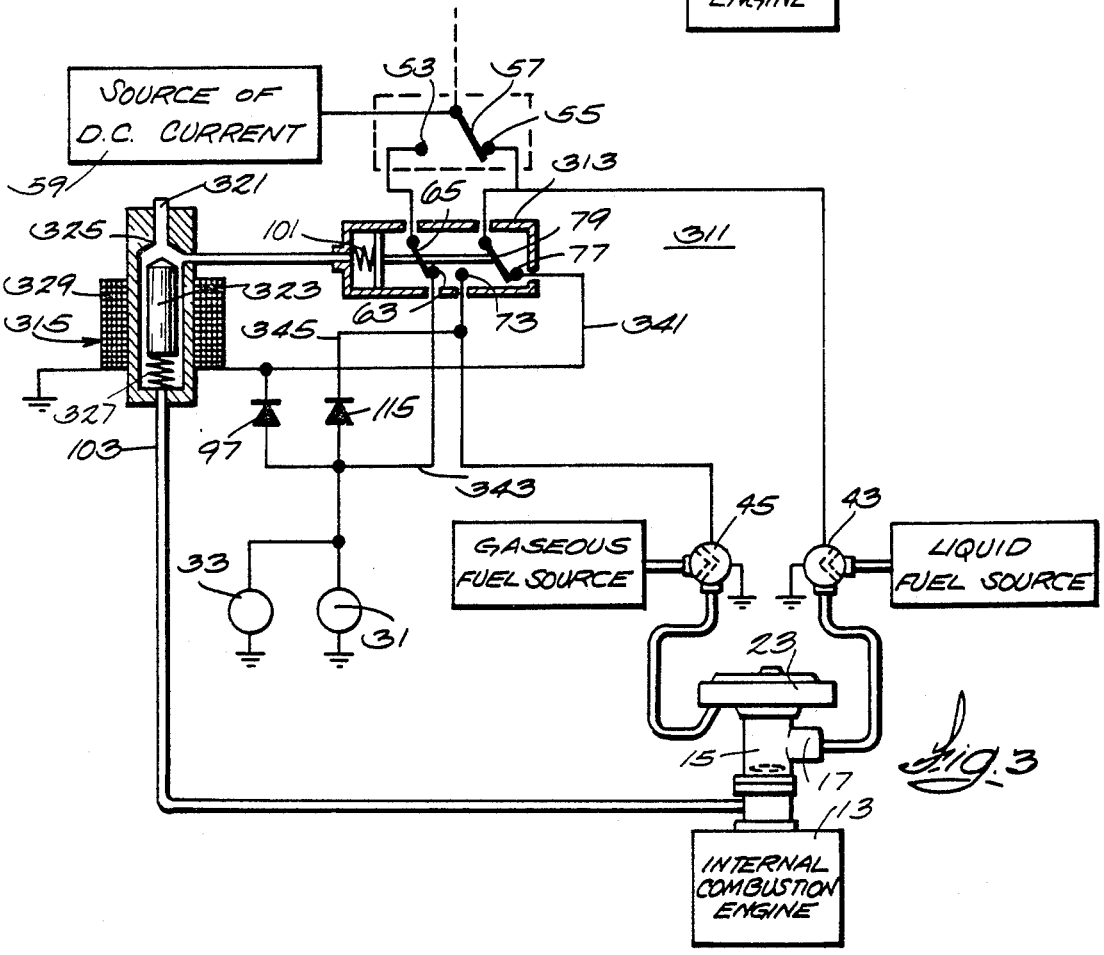
FIG. 3 is a schematic view of still another embodiment of a control apparatus for selectively operating an internal combustion engine on differing fuels.

Shown in FIG. 3 is still another control apparatus 311 for selectively operating an internal combustion engine 13 on a first or gaseous fuel and on a second or liquid fuel. As various of the components of the control apparatus 311 are identical to like components of the control apparatus 11 shown in FIG. 1, the same reference numerals as applied in FIG. 1 are also applied to like components of the control apparatus 311 shown in FIG. 3 and no further description will be provided.

The control apparatus 311 shown in FIG. 3 differs primarily from the control apparatus 11 shown in FIG. 1 by employment of a double pole vacuum switch 313 in lieu of the first and second switches 61 and 71 and by employment of a solenoid operated vent mechanism or device 315 which is inserted in the vacuum line 103 extending between the vacuum switch 313 and the engine intake manifold 105 and which serves to control operation of the vacuum switch 313 in addition to the operation thereof produced by reason of variation in vacuum at the engine intake manifold 105.

More particularly, in the control apparatus 311 shown in FIG. 3, the vacuum switch 313 includes a first switch member 65 electrically connected to the gaseous fuel terminal 53 and movable relative to terminal 63, and a second switch member 79 electrically connected to the liquid fuel terminal 55 and movable relative to the terminals 73 and 77. The switch members 65 and 79 move in unison and are biased by the spring 101 to the positions respectively engaging the terminals 63 and 77.

The vent mechanism 315 includes a vent branch duct 321 communicating with the atmosphere and a valve member 323 movable relative to a valve seat 325 between open and closed positions. The valve member 323 is biased toward the valve seat 325 by a spring 327 to normally close the vent duct 321 from the atmosphere and is displaceable against the action of the spring 327 by a solenoid coil 329 so as to displace the vent valve member 323 to the open position and thereby dissipate or vent the vacuum, whereby to permit the vacuum motor spring 101 to displace the switch members 65 and 79 into engagement with the terminals 63 and 77.

The solenoid coil 329 is connected by a lead 341 to the holding terminal 77 and by a lead 343 to the terminal 63. Thus energizing of either of the terminals 63 and 77 energizes the solenoid coil 329 to open the vent 321 directly to the atmosphere and permit operation of the vacuum motor spring 101 to hold or retain the engagement of the switch members 65 and 79 with the terminals 63 and 77 respectively.

As in the other embodiments, the switch members 65 and 79 are initially closed after switching of the first selector lever 57 in response to the absence of a vacuum condition above a predetermined limit at the vacuum switch 313. As previously indicated, such absence occurs in response to engine operation. The absence of a vacuum condition at the vacuum switch 313 above the predetermined limit permits the spring 101 to engage the switch members 65 and 79 with the contacts 63 and 77 so as to thereafter hold the switch members 65 and 79 in engagement with the contacts 63 and 77 until repositioning of the fuel selector lever 57 permits closure of the vent valve member 323 by the spring 327.

The control apparatus 311 includes a diode 115 in a lead 345 connecting the terminal 73 to the spark advance means 31 and to the inlet air heating means 33, for the same purpose as indicated with respect to control apparatus 11 shown in FIG. 1. In addition, the control apparatus 311 includes a diode 97 which prevents energization of the gaseous fuel control valve 45, the spark advance means 31, and the inlet air heating means 33 from the terminal 77.

In general, the operation of the control apparatus 311 shown in FIG. 3 is substantially the same as described with respect to the FIG. 1 control apparatus 11 shown in FIG. 1, except for the modifications referred to above.

Figure 4:
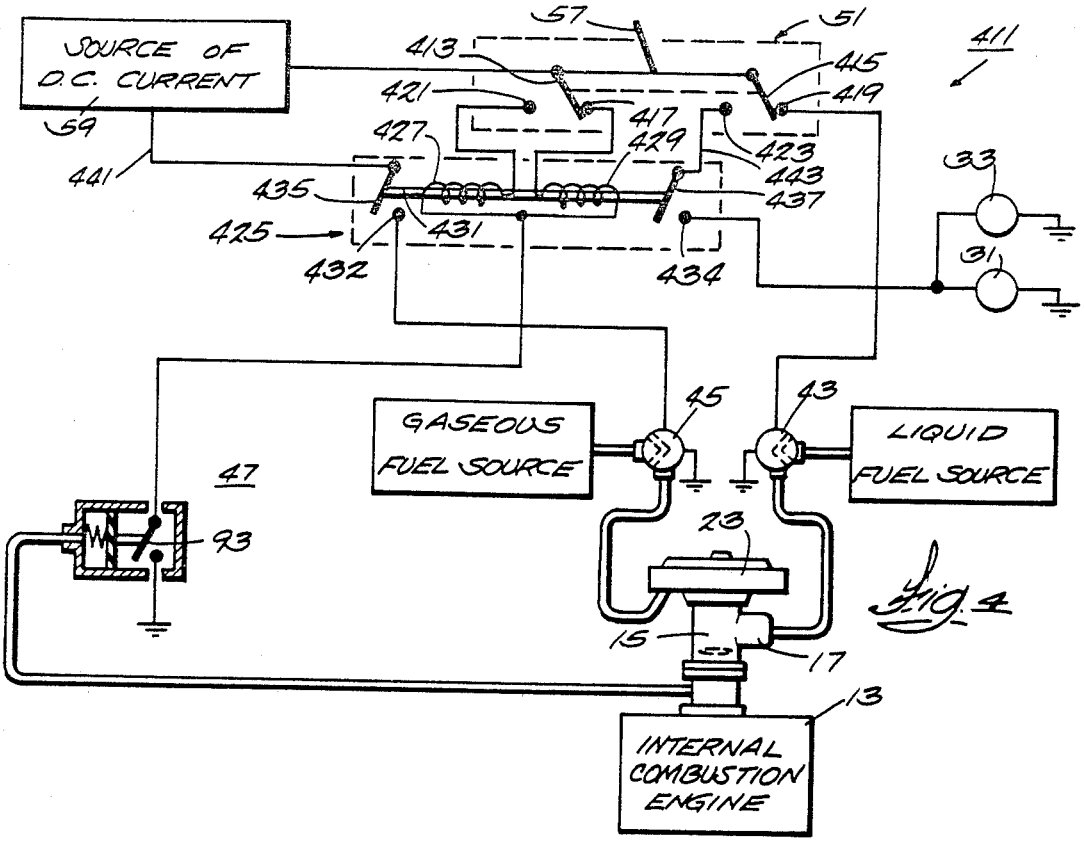
FIG. 4 is a schematic view of still another embodiment of a control apparatus for selectively operating an internal combustion engine on differing fuels.

Shown in FIG. 4 is still another control apparatus 411 for selectively operating an internal combustion engine on a first or gaseous fuel and on a second or liquid fuel. As various of the components of the control apparatus 411 are identical to like components of the control apparatus 11 shown in FIG. 1, the same reference numerals as applied in FIG. 1 are also applied to like components of the control apparatus 411, and no further description will be provided except as follows.

The control apparatus 411 differs primarily from the control apparatus 11 of FIG. 1 in that the fuel selector switch 51 comprises a double pole double throw switch which is manually controlled by an operator through a fuel selector lever 57, the fuel selector switch includes first and second switch members 413 and 415 which are movable with the fuel selector lever 57, which are connected to a source of direct current 59, and which are movable in unison between a gaseous fuel position and a liquid fuel position which is shown in full lines in FIG. 4.

When the fuel selector lever 57 is in the liquid fuel position, the switch member 413 engages a terminal 417 and the switch member 415 engages a terminal 419 which is electrically connected directly to the liquid fuel control valve 43. When the fuel selector switch 57 is in the gaseous fuel position, the switch member 413 engages a terminal 421 and the switch member 415 engages a terminal 423.

The terminals 417, 421 and 423 are connected to a fuel control relay 425 which includes first and second solenoid coils 427 and 429, repsectively, and an armature 431 which is biased by an overcenter spring (not shown) and held by said spring to the right or to the left after the armature 431 is moved to the left by solenoid coil 429 or moved to the right by solenoid coil 427 respectively as shown in FIG. 4. The fuel control relay 425 includes terminals 432 and 434 and first and second switch members 435 and 437, respectively, which are movable in unison by the armature 431 between first positions respectively engaged with the terminals 432 and 434 and second positions disengaged from the terminals 432 and 434. The terminal 434 is electrically connected to the spark advance means 32 and to the inlet air heating means 33.

More particularly, the solenoid coils 427 and 429 are respectively electrically connected, at one end, to the terminals 421 and 417 of the fuel selector switch 52. The other ends of the solenoid coils 427 and 429 are connected to the switch member 93 of the vacuum switch 47. The switch member 435 is electrically connected by a lead 441 to a source of direct current which can be the source 59 and the switch member 437 is electrically connected by a lead 443 to the terminal 423 of the fuel selector switch 51.

In operation, when switching from liquid fuel to gaseous fuel, the switch member 415 is disconnected from the terminal 419 and engaged with the terminal 423. Consequently, the liquid fuel control valve 43 is de-energized and turns off liquid fuel supply to the carburetor 15. However, the engine 13 continues to run on the liquid fuel in the carburetor bowl 17. At idle or normal road speeds and until the engine 13 begins to run out of the liquid fuel in the float bowl 17, the inlet manifold vacuum remains above the predetermined level of the vacuum switch 47. The inlet manifold vacuum then drops to an amount less than or below the predetermined level, thereby closing the vacuum switch 47, which energizes the solenoid coil 427 so as to move the armature to the right and thereby connect the switch members 435 and 437 to the terminals 432 and 434, thereby energizing the gaseous fuel control valve 45 to the open position and thereby also energizing the spark advance means 31 and the inlet air heating means 33.

To change to liquid fuel from gaseous fuel, the operator moves the fuel selector switch 51 to the liquid fuel position. Such movement engages the switch member 415 with the terminal 419, thereby energizing the liquid fuel control valve 43 to the open position. Consequently, the carburetor bowl 17 begins to fill. However, the engine 13 will not run on liquid fuel until the carburetor bowl 17 is nearly full. During the time interval when the carburetor bowl is filling, the gaseous fuel control valve 45 is retained open by engagement of the switch member 425 with the terminal 432 under the influence of the armature biasing spring (not shown). Thus the engine 13 continues to run on gaseous fuel with the vacuum condition at the vacuum switch 47 above the predetermined level until the engine 13 begins to run on both fuels. The vacuum condition at the vacuum switch 47 then drops below the predetermined level, thereby closing the vacuum switch 47, which closure energizes the solenoid coil 429. Energizing of the solenoid coil 429 shifts the switch member 435 away from the terminal 432 thereby de-energizing the gaseous fuel valve 45 so as to discontinue gaseous fuel to the mixing chamber 23. The spark advance means 31 and the inlet air heating means 33 are also electrically deenergized immediately upon the shifting of the fuel selector switch 51 to the liquid fuel position in view of the movement of the switch member 415 away from the terminal 423. As already pointed out, if such de-energization of the spark advance means 31 and the inlet air heating means 33 is not accomplished, the vacuum condition of the vacuum switch 47 may remain greater than the predetermined level when idling on both fuels; thereby preventing closure of the vacuum switch 47 and completion of the changeover to liquid fuel.

Figure 5:
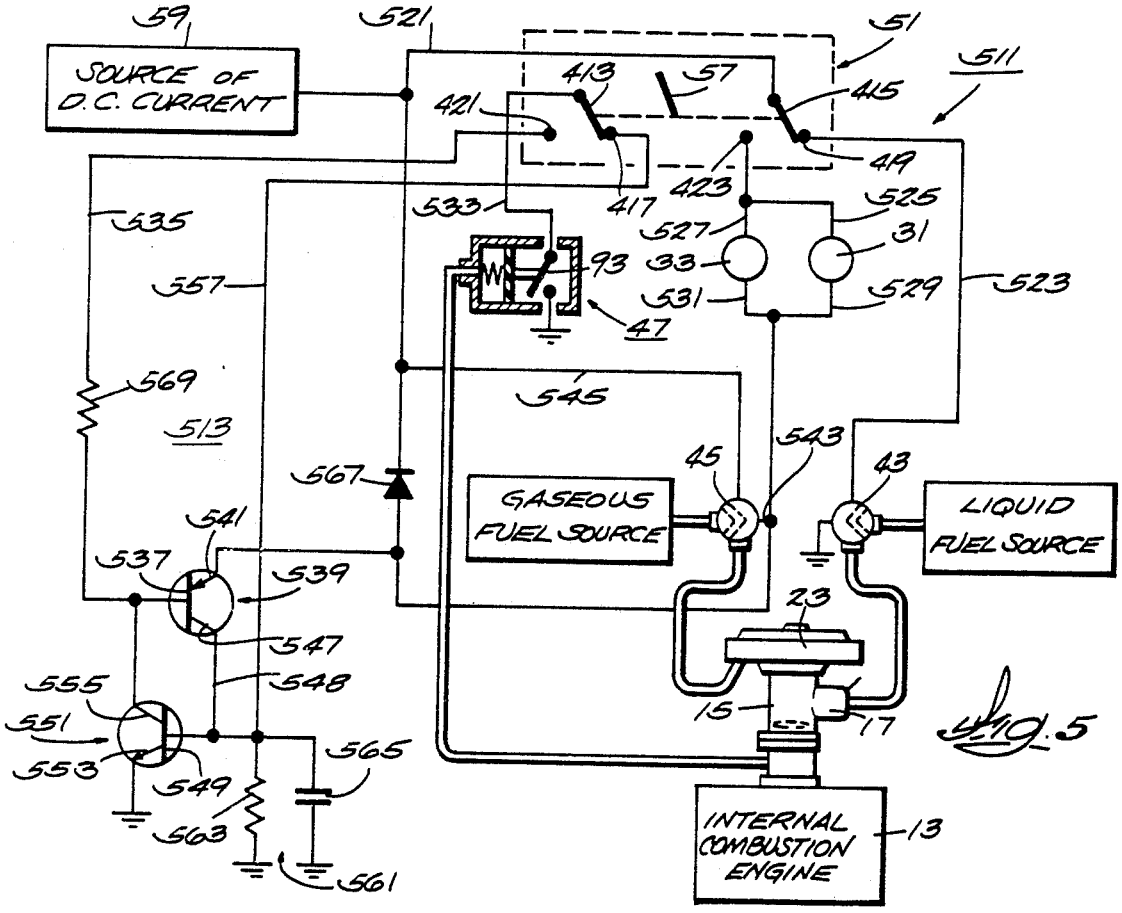
FIG. 5 is a schematic view of still another embodiment of a control apparatus for selectively operating an internal combustion engine on differing fuels.

Shown in FIG. 5 is still another embodiment of a control apparatus 511 for selectively operating an internal combustion engine 13 on either a gaseous fuel or a liquid fuel. As distinguished from the control apparatus 411 shown in FIG. 4, the control apparatus 511 includes an electronic switching circuit 513 in place of the fuel control relay switch 425 and the various components are wired somewhat differently. The components of the control apparatus 511 shown in FIG. 5 which are basically the same as in the control apparatus 411 of FIG. 4 will be referred to by the same references numbers and no further description will be provided.

As distinguished from the control apparatus 411 of FIG. 4, in the control apparatus 511, only the switch member 415 of the primary of fuel selector switch 51 is connected through a lead 521 to the source 59 of direct current. In turn, as in the FIG. 4 control apparatus 411, the liquid fuel terminal 419 of the primary or fuel selector switch 51 is connected by a lead 523 to the liquid fuel control valve 43 which is grounded. The terminal 423 of the fuel selector switch 51 is connected by respective leads 525 and 527 to the spark advancing means 31 and the intake air heating means 33. In turn, these components are connected by respective leads 529 and 531 to the electronic switching circuit 513 still to be described.

The switch member 93 of the vacuum switch 47 is electrically connected by a lead 533 to the switch member 413 of the fuel selector switch 51, which switch member 413 is operable between the terminal 421 and the terminal 417. The terminal 421 is connected by a lead 535 to the base 537 of a first transistor 539 which has an emitter 541 connected to the leads 529 and 531 extending from the the spark advance means 31 and the inlet air heating means 33. The emitter 541 is also connected through a lead 543 with an electrically operated gaseous fuel control valve 45 which, in turn, is connected through a lead 545 with the direct current source 59.

The collector 547 of the transistor 539 is electrically connected by a lead 548 to the base 549 of a second transistor 551 having an emitter 553 connected to ground. In addition, the second transistor 551 includes a collector 555 connected to the lead 535 and to the base 537 of the first transistor 539. Still further and in addition, the base 549 of the second transistor 551 is connected by a lead 557 with the terminal 417 of the primary or fuel selector switch 51.

Also connected to the second transistor base 549 is a filter 561 which functions to prevent operation of the second transistor 551 by electrical noise and which includes a resistor 563 connected between the second transistor base 549 and ground and a capacitor 565 connected between the second transistor base 549 and ground in parallel with the resistor 563.

Still further and in addition, a free-wheeling diode 567 is connected around the gaseous fuel control valve 45 to provide a free-wheeling path for the inductance of the gaseous fuel control valve 45. Still further, a resistor 569 is included in the lead 535 to limit the base current to the first transistor 539.

In operation, when the selector lever 57 is moved to the gaseous fuel position, the liguid fuel control valve 43 is turned off to preclude further fuel supply to the carburetor 15, but the engine 13 continues to run on the fuel in the carburetor bowl 17. At this time, the first and second transistors 539 and 551 are non-conducting. Accordingly, the gaseous fuel control valve 45, the spark advance means 31, and the intake air heating means 33 are de-energized. As the engine runs out of liquid fuel, the manifold vacuum drops and the vacuum switch 47 closes, causing a base current to flow through the terminal 421 and lead 535 to the base 537 of the first transistor 539. Since the first and second transistors 539 and 551 are connected as a latching pair, the first transistor 539 supplies a base current to the base 549 of the second transistor 551 and the second transistor 551 turns on, insuring continues base drive to the first transistor 539, even after opening of the vacuum switch 47. The conducting condition of the regenerative pair of transistors 539 and 551 causes the gaseous fuel control valve 45, the spark advance means 31 and the intake air means heading 33 to be energized. As a consequence, the engine 11 operates on the gaseous fuel.

When the selector lever 57 is moved to the gasoline position, the liquid fuel control valve 43 is energized, allowing flow of the liquid fuel to the carburetor float bowl 17. In addition, the spark advance means 31 and intake air heating means 33 are immediately de-energized. The gaseous fuel control valve 45 remains energized by virtue of the latched condition of the first and second transistors 539 and 551. However, as the float bowl 17 fills, the engine 13 runs rich and begins to stall with the result that the manifold vacuum drops, thereby closing the vacuum switch 47. Such closure causes the base drive of the second transistor 551 to be shorted to ground, shutting off both the first and second transistors 539 and 551 by virtue of interruption of base current. The regenerative pair transistors 539 and 551 thus shuts off and remains shut off even after the opening of vacuum switch 47. The gaseous fuel control valve 45 is thus closed and the engine 13 runs on liquid fuel.

Prior currently available dual fuel systems for employing liquid fuel and gaseous fuel require the operator to go through a specified procedure to change fuel. In these systems, to change fuel from gasoline to natural gas, the operator turns off the gasoline valve, waits until the fuel in the carburetor is used, and then turns on the natural gas. To change back to gasoline, the operator turns on the gasoline valve, waits until the engine begins to flood, and then turns off the natural gas valve. The operator must know the spcific procedure required for the particular conversion system in order to make a fuel change. Thus the disclosed apparatus for shifting from gaseous fuel to liquid fuel, and vice-versa, is unique and simplifies the previous change-over procedure.

Various of the features of the invention are set forth in the following claims.

I claim:

1. Apparatus for controlling operation of an internal combustion engine which includes an intake manifold and which is selectively operable using gaseous fuel or liquid fuel, said apparatus comprising a gaseous fuel supply line extending between the engine and a source of gaseous fuel, a liquid fuel supply line extending between the engine and a source of liquid fuel, and means for controlling supply to the engine of the gaseous fuel and the liquid fuel, said control means including an operator controlled fuel selector switch comprising a first switch element connected to a source of electrical current and movable between a gaseous fuel position and a liquid fuel position, said control means being operable following prior engine operation with gaseous fuel and in response to movement of said fuel selector switch from said gaseous fuel position to said liquid fuel position for permitting liquid fuel flow through said liquid fuel supply line, for permitting continued gaseous fuel flow through said gaseous fuel supply line until initiation of liquid fuel combustion, and thereafter preventing further gaseous fuel flow through said gaseous fuel supply line until repositioning of said fuel selector switch to said gaseous fuel position, said control means also being operable following prior engine operation with liquid fuel and in response to movement of said fuel selector switch from said liquid fuel position to said gaseous fuel position for preventing further liquid fuel flow through said liquid fuel supply line, for preventing gaseous fuel flow through said gaseous fuel supply line until termination of liquid fuel combustion, and for thereafter permitting gaseous fuel flow through said gaseous fuel supply line until repositioning of said fuel selector switch to said liquid fuel position.

2. Apparatus in accordance with claim 1 wherein said control means also includes vacuum operated means responsive to engine vacuum conditions for controlling gaseous fuel flow through said gaseous fuel supply line.

3. Apparatus in accordance with claim 1 wherein said control means further includes a solenoid switch operable, when energized, to open said gaseous fuel supply line, and a vacuum-controlled switch electrically connected to said solenoid switch to effect energization thereof in response to a vacuum condition above a predetermined level.

4. Apparatus in accordance with claim 1 wherein said control means further includes an electronic circuit coupled to said gaseous fuel supply line for opening and closing thereof, and a vacuum switch which is normally closed in the absence of a vacuum above a predetermined level, said vacuum switch being connected in series with said electronic circuit and said fuel selector switch.

5. Apparatus for controlling operation of an internal combustion engine which is selectively operable using gaseous fuel or liquid fuel, said apparatus comprising means for supplying a gaseous fuel to the engine, means for supplying a liquid fuel to the engine, and control means adapted to be connected to a source of vacuum which is responsive to engine operation and which varies relative to a predetermined level, said control means including a fuel selector switch comprising a first switch element connected to a source of current and movable between a gaseous fuel position and a liquid fuel position, an electrically operated, normally closed gaseous fuel control valve which is located in said gaseous fuel supply means, which is operable between open and closed positions, and which is opened in response to electrical energization thereof, and an electrically operated, normally closed liquid fuel control valve which is located in said liquid fuel supply means, which is operable between open and closed positions, and which is opened in response to electrical energization thereof, said control means being operable, when said selector switch is in said liquid fuel position, to energize said liquid fuel control valve, thereby opening said liquid fuel control valve, said control means also being operable, when said selector switch is in said liquid fuel position and in response to the presence of an amount of vacuum above said predetermined level to energize said gaseous fuel control valve, said control means also being operable, when said selector switch is in said liquid fuel position and in response to the presence of an amount of vacuum below said predetermined level, to deenergize said gaseous fuel control valve, and thereby close said gaseous fuel control valve, and thereafter to retain said gaseous fuel control valve deenergized regardless of vacuum variation, said control means also being operable, when said selector switch is in said gaseous fuel position, to deenergize said liquid fuel control valve, thereby closing said liquid fuel control valve, said control means also being operable, when said selector switch is in said gaseous fuel position and in response to an amount of vacuum above said predetermined level, to deenergize said gaseous fuel control valve, thereby closing said gaseous fuel control valve, and said control means also being operable, when said selector switch is in said gaseous fuel position and in response to an amount of vacuum below said predetermined level, to energize said gaseous fuel control valve and thereby open said gaseous fuel control valve, and thereafter to retain energization of said gaseous fuel control valve regardless of vacuum variation.

6. Apparatus in accordance with claim 5 wherein said apparatus further includes electrically operated spark advance means electrically connected to said control means and operable in response to energization thereof to advance the sparking time, and electrically operated intake air heating means electrically connected to said control means and operable in response to energization to prevent heating of the incoming air, and wherein said control means is inoperable, when said selector switch is in said liquid fuel position, to energize said spark advance means and said air intake means, and wherein said control means also being operable, when said selector switch is in said gaseous fuel position and in response to an amount of vacuum above said predetermined level, to deenergize said spark advance means and said inlet air heating means, and said control means also being operable, when said selector switch is in said gaseous fuel position and in response to an amount of vacuum below said predetermined level, to energize said spark advance means and said inlet air heating means, and thereafter to retain energization of said spark advance means and said intake air heating means regardless of vacuum variation.

7. Apparatus in accordance with claim 6 wherein said selector switch comprises a gaseous fuel terminal, a liquid fuel terminal, and a primary switch member connected to a source of direct current and movable between a first position energizing said gaseous fuel terminal and a second position energizing said liquid fuel terminal, wherein said control means further includes first switch means including a first terminal connected to said gaseous fuel control valve, to said spark advance means, and to said intake air heating means, a first switch member electrically connected to said gaseous fuel terminal and movable relative to a position energizing said first terminal, and thereby energizing said gaseous fuel control valve, said spark advance means, and said intake air heating means, said first switch member being biased away from said first terminal, and means for holding said first switch member in said position energizing said first terminal in response to energizing of said first terminal, wherein said control means further includes second switch means including a terminal connected to said gaseous fuel control valve, a holding terminal, a second switch member electrically connected to said liquid fuel terminal and movable between a first position engaging said terminal connected to said gaseous fuel control valve for energizing thereof, and a second position engaging said holding terminal, said second switch member being biases to said first position, and means connected to said holding terminal for holding said second switch member in said second position when said holding terminal is energized by said second switch member, wherein said control means further includes vacuum switch means connected to a source of direct current and to said first and second switch means and operable between an open position in response to the presence of an amount of vacuum above said predetermined level and a second position which is normally closed in the absence of the presence of an amount of vacuum above said predetermined level and which is operable to connect said first switch member to said holding terminal, and wherein said control means further includes a diode for preventing energization of said spark advance means and said intake air heating means when said primary switch member is in said liquid fuel position.

8. Apparatus in accordance with claim 7 wherein said engine includes a fuel inlet manifold and said vacuum switch communicates with said fuel inlet manifold and is subject to the pressure variation in said fuel inlet manifold.

9. Apparatus in accordance with claim 5 wherein said control means includes a solenoid switch operable, when energized, to open said gaseous fuel control valve, and a vacuum-controlled switch electrically connected to said solenoid switch to effect energization thereof in response to a vacuum condition above a predetermined level.

10. Apparatus in accordance with claim 5 wherein said fuel selector switch further comprises a second switch member connected to a source of current and movable in unison with said first switch member between a gaseous fuel position and a liquid fuel position.

11. Apparatus in accordance with claim 10 wherein said control means further includes a secondary switch comprising a solenoid coil electrically connected to one of said first and second switch members when said fuel selector switch is in said gaseous fuel position, and a third switch operated by said solenoid coil, electrically connected to a source of direct current, and operable in response to energization of said solenoid to energize said gaseous fuel control valve.

12. Apparatus in accordance with claim 11 wherein said control means further includes a vacuum switch which is normally closed in the absence of a vacuum above a predetermined level and which is connected to said solenoid coil for energization thereof when said fuel selector switch is in the gaseous fuel position and when said vacuum switch is closed.

13. Apparatus in accordance with claim 12 wherein said control means includes means operable after initial energizing of said solenoid coil for maintaining said solenoid coil energized until movement of said fuel selector switch to said liquid fuel position and regardless of the vacuum condition at said vacuum switch.

14. Apparatus in accordance with claim 5 wherein said control means further includes a secondary switch comprising a solenoid coil and a second switch member operated by said solenoid coil and electrically connectable to said first switch member and operable to energize said gaseous fuel control valve.

15. Apparatus in accordance with claim 14 wherein said control means further includes a vacuum switch which is connected to a source of current, which is normally closed in the absence of a vacuum above a predetermined level, and which is connected to said solenoid cil for energization thereof when said vacuum switch is closed so as to energize said gaseous fuel control valve.

16. Apparatus in accordance with claim 15 wherein said control means includes means operable after initial energizing of said solenoid coil for maintaining said solenoid coil energized until movement of said fuel selector switch to said liquid fuel position and regardless of the vacuum condition at said vacuum switch.

17. A control in accordance with claim 5 wherein said control means further includes an electronic circuit coupled to said gaseous fuel control valve for opening and closing thereof, and a vacuum switch which is normally closed in the absence of a vacuum above a predetermined level, said vacuum switch being connected in series with said electronic circuit and said fuel selector switch.

18. Apparatus in accordance with claim 17 wherein said electronic circuit further includes means operable, in response to initial energizing thereof incident to positioning of said fuel selector switch in the gaseous fuel position and when said vacuum switch is closed, for thereafter maintaining said gaseous fuel control valve open until movement of said fuel selector switch to said liquid fuel position and regardless of the vacuum condition at said vacuum switch.

19. A control in accordance with claim 17 wherein said fuel selector switch includes a gaseous fuel terminal, a liquid fuel terminal and a switch member engaged with said gaseous fuel terminal when said fuel selector switch is in said gaseous fuel position and engaged with said liquid fuel terminal when said fuel selector switch is in said liquid fuel position.

20. Apparatus in accordance with claim 19 wherein said electronic circuit further includes first and second transistors in latching connecting, said first transistor including a base electrically connected to said gaseous fuel terminal of said fuel selector switch and said second transistor including a base electrically connected to said liquid fuel terminal of said fuel selector switch.

21. Apparatus for controlling operation of an internal combustion engine which is selectively operable using gaseous fuel or liquid fuel, said apparatus comprising means for supplying a gaseous fuel to the engine, means for supplying a liquid fuel to the engine, and control means including a vacuum operated switch adapted to be connected to a source of vacuum which is responsive to engine operation and which varies relative to a predetermined level, said switch being biased so that, in the absence of a vacuum condition above a pre-determined level, said switch is closed, said control means also including a fuel selector switch movable between a gaseous fuel position and a liquid fuel position, an electrically operated, normally closed gaseous fuel control valve which is located in said gaseous fuel supply means, which is operable between open and closed positions, and which is opened in response to electrical energization thereof, and an electrically operated, normally closed liquid fuel control valve which is located in said liquid fuel supply means, which is operable between open and closed positions, and which is opened in response to electrical energization thereof, said control means being operable, when said selector switch is in said liquid fuel position, to energize said liquid fuel control valve, thereby opening said liquid fuel control valve, said control means also being operable, when said selector switch is in said liquid fuel position and in response to the presence of an amount of vacuum above said predetermined level to energize said gaseous fuel control valve, said control means also being operable, when said selector switch is in said liquid fuel position and in response to the presence of an amount of vacuum below said predetermined level, to deenergize said gaseous fuel control valve, and thereby close said gaseous fuel control valve, and thereafter to retain said gaseous fuel control valve deenergized regardless of vacuum variation, said control means also being operable, when said selector switch is in said gaseous fuel position, to deenergize said liquid fuel control valve, thereby closing said liquid fuel control valve, said control means also being operable, when said selector switch is in said gaseous fuel position and in response to an amount of vacuum above said predetermined level, to deenergize said gaseous fuel control valve, thereby closing said gaseous fuel control valve, and said control means also being operable, when said selector switch is in said gaseous fuel position and in response to an amount of vacuum below said predetermined level, to energize said gaseous fuel control valve and thereby open said gaseous fuel control valve, and thereafter to retain energization of said gaseous fuel control valve regardless of vacuum variation.

22. A control in accordance with claim 21 wherein said engine includes an intake manifold, wherein said control means includes a conduit communicating between said engine intake manifold and said secondary switch, said conduit including a branch vent line communicable with the atmosphere, a valve member movable between a first position closing said branch vent line and a second position permitting communication of said branch vent line with the atmosphere, means biasing said valve member to said first position, and means for displacing said valve member against the action of said biasing means to said second position.

23. Apparatus in accordance with claim 22 wherein said fuel selector switch is connected to a source of current, and wherein said means for displacing said valve member to the second position comprises a solenoid electrically energized through said fuel selector switch.

24. Apparatus in accordance with claim 21 wherein said control means includes a solenoid switch operable, when energized, to open said gaseous fuel control valve and electrically connected to said vacuum switch to effect energization of said solenoid switch in response to a vacuum condition above a pre-determined level at said vacuum switch.

25. Apparatus in accordance with claim 21 wherein said control means further includes an electronic circuit which is coupled to said gaseous fuel control valve for opening and closing thereof, and which is electrically connected in series with said vacuum switch and said fuel selector switch.

26. Engine control apparatus including an internal combustion engine which includes an intake manifold which is selectively operable using gaseous fuel, means for supplying a gaseous fuel to said engine, means for supplying a liquid fuel to said engine, and control means including a vacuum operated switch adapted to be connected to a source of vacuum which is responsive to engine operation and which varies relative to a predetermined level, said switch being biased so that, in the absence of a vacuum condition alone the predetermined level, said switch is closed, a conduit communicating between said engine manifold and said vacuum switch, said control means also including a fuel selector switch movable between a gaseous fuel position and a liquid fuel position, an electrically operated, normally closed gaseous fuel control valve which is located in said gaseous fuel supply means, which is operable between open and closed positions, and which is opened in response to electrical energization thereof, and an electrically operated, normally closed liquid fuel control valve which is located in said liquid fuel supply means, which is operable between open and closed positions, and which is opened in response to electrical energization thereof, said control means being operable, when said selector switch is in said liquid fuel position, to energize said liquid fuel control valve, thereby opening said liquid fuel control valve, said control means also being operable, when said selector switch is in said liquid fuel position and in response to the presence of an amount of vacuum above said predetermined level, to energize said gaseous fuel control valve, said control means also being operable, when said selector switch is in said liquid fuel position and in response to the presence of an amount of vacuum below said predetermined level, to deenergize said gaseous fuel control valve, and thereby close said gaseous fuel control valve, and thereafter to retain said gaseous fuel control valve deenergized regardless of vacuum variation, said control means also being operable, when said selector switch is in said gaseous fuel position, to deenergize said liquid fuel control valve, thereby closing said liquid fuel control valve, said control means also being operable, when said selector switch is in said gaseous fuel position and in response to an amount of vacuum above said predetermined level, to deenergize said gaseous fuel control valve, thereby closing said gaseous fuel control valve, and said control means also being operable, when said selector switch is in said gaseous fuel position and in response to an amount of vacuum below said predetermined level, to energize said gaseous fuel valve and thereby open said gaseous fuel control valve, and thereafter to retain energization of said gaseous fuel control valve regardless of vacuum variation.

27. Apparatus in accordance with claim 26 wherein said apparatus further includes electrically operated spark advance means electrically connected to said control means and operable in response to energization thereof to advance the sparking time, and electrically operated intake air heating means electrically connected to said control means and operable in response to energization to prevent heating of the incoming air, and wherein said second switch comprises first and second switch members movable in unison between a normally engaged position and a second position, and wherein said first switch member is electrically connected to said gaseous fuel control valve for energization thereof when said switch members are in said second position, and wherein said second switch member is electrically connected to said spark advance means and to said intake air heating means for energization thereof when said switch members are in said normally engaged position.

28. Apparatus in accordance with claim 27 wherein said secondary switch includes a solenoid coil operable to move said first and second switch members to said second position in response to energization thereof.

29. Apparatus in accordance with claim 28 wherein said engine includes an intake manifold, and wherein said secondary switch is vacuum operated and is operable to move said first and second switch members to said second position in response to the presence at said secondary switch of a vacuum condition above a predetermined level, and further including a conduit communicating between said engine manifold and said vacuum switch.

30. Apparatus in accordance with claim 26 wherein said control means includes a solenoid switch operable, when energized, to open said gaseous fuel control valve and electrically connected to said vacuum switch to effect energization of said solenoid switch in response to a vacuum condition above a pre-determined level at said vacuum switch.

31. Apparatus in accordance with claim 26 wherein said control means further includes an electronic circuit which is coupled to said gaseous fuel control valve for opening and closing thereof, and which is electrically connected in series with said vacuum switch and said fuel selector switch.

32. Apparatus for controlling operation of an internal combustion engine which is selectively operable using gaseous fuel or liquid fuel, said apparatus comprising a gaseous fuel supply line extending between the engine and a source of gaseous fuel, a liquid fuel supply line extending between the engine and a source of liquid fuel, and means for controlling supply to the engine of the gaseous fuel and the liquid fuel, said control means including an operator controlled fuel selector switch movable between a gaseous fuel position and a liquid fuel position, and a vacuum operated switch which is biased so that, in the absence of a vacuum condition above a pre-determined level, said vacuum switch is closed, said control means being operable, following prior engine operation with gaseous fuel and in response to movement of said fuel selector switch from said gaseous fuel position to said liquid fuel position, for permitting liquid fuel flow through said liquid fuel supply line, for permitting continued gaseous fuel flow through said gaseous fuel supply line until initiation of liquid fuel combustion, and thereafter preventing further gaseous fuel flow through said gaseous fuel supply line until repositioning of said fuel selector switch to said gaseous fuel position, said control means also being operable following prior engine operation with liquid fuel and in response to movement of said fuel selector switch from said liquid fuel position to said gaseous fuel position for preventing further liquid fuel flow through said liquid fuel supply line, for preventing gaseous fuel flow through said gaseous fuel supply line until termination of liquid fuel combustion, and for thereafter permitting gaseous fuel flow through said gaseous fuel supply line until repositioning of said fuel selector switch to said liquid fuel position.

33. Apparatus in accordance with claim 32 wherein said control means further includes a solenoid switch which is operable, when energized, to open said gaseous fuel control valve and which is electrically connected to said vacuum switch to effect energization of said solenoid switch in response to a vacuum condition above a pre-determined level at said vacuum switch.

34. Apparatus in accordance with claim 32 wherein said control means further includes an electronic circuit which is coupled to said gaseous fuel supply line for opening and closing thereof and which is electrically connected in series with said vacuum switch and said fuel selector switch.

35. An engine control apparatus including an internal combustion engine which includes an intake manifold and which is selectively operable using gaseous fuel or liquid fuel, a gaseous fuel supply line extending between said engine and a source of gaseous fuel, a liqiud fuel supply line extending between said engine and a source of liquid fuel, and means for controlling supply to said engine of the gaseous fuel and the liquid fuel, said control means including an operator controlled fuel selector switch movable between a gaseous fuel position and a liquid fuel position, a vacuum operated switch which is biased so that, in the absence of a vacuum condition above a pre-determined level, said vacuum switch is closed, and a conduit communicating between said engine manifold and said vacuum switch, said control means being operable, following prior engine operation with gaseous fuel and in response to movement of said fuel selector switch from said gaseous fuel position to said liquid fuel position, for permitting liquid fuel flow through said liquid fuel supply line, for permitting continued gaseous fuel flow through said gaseous fuel supply line until initiation of liquid fuel combustion, and thereafter preventing further gaseous fuel flow through said gaseous fuel supply line until repositioning of said fuel selector switch to said gaseous fuel position, said control means also being operable, following prior engine operation with liquid fuel and in response to movement of said fuel selector switch from said liquid fuel position to said gaseous fuel position, for preventing further liquid fuel flow through said liquid fuel supply line, for preventing gaseous fuel flow through said gaseous fuel supply line until termination of liquid fuel combustion, and for thereafter permitting gaseous fuel flow through said gaseous fuel supply line until repositioning of said fuel selector switch to said liquid fuel position.

36. Apparatus in accordance with claim 35 wherein said control means further includes a solenoid switch which is operable, when energized, to open said gaseous fuel supply line and which is electrically connected to said vacuum switch to effect energization of said solenoid switch in response to a vacuum condition above a pre-determined level at said vacuum switch.

37. A control in accordance with claim 35 wherein said control means further includes an electronic circuit which is coupled to said gaseous fuel supply line for opening and closing thereof and which is electrically connected in series with said vacuum switch and said fuel selector switch.

* * * * *

UNITED STATES PATENT AND TRADEMARK OFFICE

CERTIFICATE OF CORRECTION

PATENT NO. : 4,489,699

DATED : December 25, 1984

INVENTOR(S) : Arthur G. Poehlman

It is certified that error appears in the above-identified patent and that said Letters Patent are hereby corrected as shown below:

Column 14, line 42, "biases" should be -- biased --.

Column 16, line 10 "connecting" should be -- connection --.

Signed and Sealed this

*Third* Day of *September 1985*

[SEAL]

*Attest:*

DONALD J. QUIGG

*Attesting Officer* *Acting Commissioner of Patents and Trademarks - Designate*